US006229120B1

(12) United States Patent
Jewell

(10) Patent No.: US 6,229,120 B1
(45) Date of Patent: May 8, 2001

(54) CONTROLLING THE POWER DISSIPATION OF A FIXING DEVICE

(75) Inventor: Robert W. Jewell, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/191,263

(22) Filed: Nov. 12, 1998

(51) Int. Cl.[7] ..... H05B 3/02
(52) U.S. Cl. ..... 219/486; 399/33; 219/216
(58) Field of Search ..... 219/216, 486, 219/497, 501, 482, 388, 494; 399/33, 69, 329; 358/1.9; 355/272, 288, 282

(56) References Cited

U.S. PATENT DOCUMENTS

| | | | | |
|---|---|---|---|---|
| 3,745,304 | * | 7/1973 | Hunter | 219/216 |
| 4,001,545 | * | 1/1977 | Wada et al. | 219/216 |
| 4,032,746 | * | 6/1977 | Barsell | 219/216 |
| 4,163,892 | * | 8/1979 | Komatsu et al. | 219/216 |
| 4,862,225 | * | 8/1989 | Heiller et al. | 355/288 |
| 4,912,514 | * | 3/1990 | Mizutani | 355/272 |
| 5,229,577 | * | 7/1993 | Matsuura et al. | 219/497 |
| 5,245,393 | | 9/1993 | Storlie et al. | 355/290 |
| 5,350,896 | * | 9/1994 | Amico et al. | 219/216 |
| 5,483,149 | | 1/1996 | Barrett | 323/300 |
| 5,537,515 | * | 7/1996 | Yokoyama et al. | 358/1.9 |
| 5,615,876 | | 4/1997 | Yergenson et al. | 271/258.01 |
| 5,659,867 | | 8/1997 | Young | 399/330 |
| 5,724,628 | * | 3/1998 | Sano | 399/33 |

* cited by examiner

*Primary Examiner*—Teresa Walberg
*Assistant Examiner*—Leonid Fastovsky
(74) *Attorney, Agent, or Firm*—Gregg W. Wisdom

(57) ABSTRACT

A fixing device, such as a halogen bulb fuser or an instant on fuser, includes a first heating element supplied with substantially constant average power by a power control circuit in preparation for and during fusing. Additionally, the instant on fuser includes a second heating element supplied by the power control circuit. The power control circuit measures the average voltage across and the average current through the first heating element to detect changes in the thermal load applied to the first heating element. In preparation for fusing, the power control circuit applies sufficient power to the second heating element for fusing the expected average thermal load. If the power control circuit detects a level of thermal loading on the instant on fuser different than the expected average thermal load, the power control circuit adjusts the power supplied to the second heating element to compensate for the level of thermal loading different than the average expected thermal load. The power control circuit includes a pulse width modulator that adjusts the duty cycle of a drive signal applied to the gate terminal of a first triac coupled in series with the first heating element to maintain substantially constant power dissipation in the first heating element. To compensate for thermal loading different than the average expected thermal load, the pulse width modulator adjusts the duty cycle of a drive signal applied to the gate terminal of a second triac coupled in series with the second heating element.

20 Claims, 5 Drawing Sheets

CONTROLLING THE POWER DISSIPATION OF A FIXING DEVICE

FIELD OF THE INVENTION

This invention relates to the fixing of toner to print media in an electrophotographic printing system. More particularly, this invention relates to a fixing device used in an electrophotographic printing system.

BACKGROUND OF THE INVENTION

Heating elements have been used to fix toner to print media in electrophotographic printing Prior art technology employs one or more resistive heating elements enclosed in a glass bulb which is inserted into a cylinder formed of a thermally conductive material such as aluminum. The exterior surface of the cylinder has a release layer formed from a low adhesion material, such as TEFLON, to reduce toner adhesion to the surface. This embodiment of a fixing device uses a kind of fuser typically referred to as a halogen bulb fuser. The heat generated by the resistive heating element is transferred to the exterior surface of the halogen bulb fuser through radiation, convection and thermal conduction through the wall of the cylinder. Frequently, the glass bulb is filled with a halogen gas to allow the heating element to be operated at a higher temperature.

Another prior art fixing device implementation, using a type of fuser known as an instant on fuser, includes a strip of material forming a resistive heating element. The resistive heating element can be formed on the ceramic substrate through a thick film deposition process. The resistive heating element is covered by a coating of glass. The coating of glass permits low friction rotation of a film sleeve over the glass as well as providing electrical insulation. Typically, in an instant on fuser, the resistive heating element is fabricated on the ceramic substrate with the electrical connections at one end of the long axis of the fuser. Multiple resistive heating elements may be used in the instant on fuser.

A significant technical problem encountered in the use of fixing devices is obtaining an accurate measurement of the temperature on the surface of the fixing device contacting the print media. Generally, in a halogen bulb fuser a single temperature sensor, such as a thermistor, is located near one end and in sliding contact with the halogen bulb fuser outside the path the print media follows as it passes over the halogen bulb fuser. During fixing, print media must pass between the halogen bulb fuser and a pressure roller. In order to permit the print media to pass between the halogen bulb fuser and the pressure roller without the risk of a paper jam, the temperature sensor is typically located on the side of the halogen bulb fuser opposite the region through which the print media passes during fixing. Additionally, in an instant on fuser, the temperature sensor is typically located on the side of the instant on fuser opposite the resistive heating elements in order to eliminate the risk of paper jams. The temperature sensor is part of a circuit which regulates the flow of power to the one or more heating elements within the fixing device in an attempt to establish a uniform temperature profile across the surface of the fixing device. Because the temperature sensor is located relatively remote from the region in which fixing occurs, the difficulty in precisely controlling the fixing temperature is increased.

Contact between the print media and the surface of the fixing device results in a decrease in the surface temperature of the fixing device in those locations on the surface contacting the print media. The temperature sensor provides a measure of the temperature on the surface of the fixing device outside of the print media path in an area which is not thermally loaded. Because of this, an assumption about the surface temperature offset between areas outside of the print media path and areas within the print media path must be made to provide effective control of the fixing device surface temperature in the region contacting the print media. As the width of the print media varies, the value of this temperature offset can change substantially as a result of differences in the thermal loading. This variation in temperature offset increases the difficulty in providing fixing device surface temperatures optimal for fixing toner.

An additional consideration is that the amount of thermal loading from the print media is variable depending upon such print media characteristics as the thermal mass of the print media, the thermal conductivity of the material used for the print media, the surface finish of the print media, and the moisture content of the print media. For example, different thermal loading of the fixing device results from papers having different weights and different surface finishes. Or, between paper of the same weight having different moisture contents, typically as a result of exposure to different humidities, the fixing device is thermally loaded to different degrees. Another factor contributing to the uncertainty of the temperature offset value is the thermal time constant associated with the fixing device and the variable thermal load of the print media. This thermal time constant results in a time varying temperature offset between locations on the surface of the fixing device inside and outside the print media path as the fixing device reaches steady state. These factors create a wide range of variability in the temperature offset between areas of the surface of the fixing device in the path of the print media and the location of the temperature sensor outside of the path of the print media. These types of problems make the use of a temperature sensor outside of the print media path unsuitable for tight control of the fixing device surface temperature.

In past attempts at improving the accuracy of the measurement of the fixing device surface temperature, temperature sensors have been placed in the path of the print media in an attempt to obtain a more accurate measurement of the surface temperature of the fixing device. However, a difficulty encountered in using conventional temperature sensors, such as thermistors, is that, fibers from the print media accumulate on the surface of the sensor and prevent it from obtaining an accurate measure of the fuser surface temperature in the print media path. This difficult has limited the usefulness of locating certain types of temperature sensors in the print media path.

Other attempts at improving the accuracy of the measurement of the fixing device surface temperature have included using temperature sensors that do not contact the surface of the fixing device and are located near the paper path. Although these implementations are less susceptible to paper jams, they are more expensive to implement and they are also susceptible to coating by airborne paper fibers which reduce their ability to reliably measure the surface temperature of the fixing device.

A need exist for an implementation of a fixing device that has the capability to provide a more accurate measurement of the temperature on the surface of the fixing device in the vicinity of the region that contacts the print media for improving control of the fixing device surface temperature while having less sensitivity to the accumulation of the paper fibers and not increasing the likelihood of paper jams.

SUMMARY OF THE INVENTION

Accordingly, a fixing device for fusing toner to print media includes a first heating element and a second heating element. The fixing device further includes a power control circuit configured for selectively supplying a substantially constant average power to the first heating element and configured for adjusting the power supplied to the second heating element in response to thermal loading of the first heating element by the print media.

In a fixing device for fixing toner to print media, with the fixing device including a power control circuit, a first heating element coupled to the power control circuit, and a second heating element coupled to the power control circuit, a method for controlling the power applied to the second heating element to compensate for thermal loading by the print media different than a predetermined level of thermal loading has been developed. The method includes the steps of applying a substantially constant average power to the first heating element and applying power to the second heating element corresponding to the predetermined level of thermal loading. The method further includes the step of adjusting the power supplied to the second heating element in response to thermal loading of the first heating element different than the predetermined level of thermal loading.

An electrophotographic printing system for printing print data on print media using toner includes a formatter arranged for receiving the print data to generate formatted print data and a scanner configured for receiving the formatted print data to generate a laser beam modulated based upon the formatted print data. The electrophotographic printing system further includes a photoconductor onto which the laser beam impinges to generate a latent electrostatic image and a developer for developing the toner onto the latent electrostatic image. Additionally, the electrophotographic printing system includes a transfer device for transferring the toner on the photoconductor onto the print media. The electrophotographic printing system further includes a fixing device including a first heating element, a second heating element, and a power control circuit configured for selectively supplying a substantially constant average power to the first heating element and configured for adjusting the power supplied to the second heating element in response to thermal loading of the first heating element by the print media.

DESCRIPTION OF THE DRAWINGS

A more thorough understanding of the invention may be had from the consideration of the following detailed description taken in conjunction with the accompanying drawings in which.

DETAILED DESCRIPTION OF THE DRAWINGS

The present invention is not limited to the specific exemplary embodiments illustrated herein. Although the embodiments of the fixing device will be discussed in the context of a monochrome electrophotographic printer, one of ordinary skill in the art will recognize by understanding this specification that the fixing device has applicability in both color and monochrome electrophotographic image forming systems. Furthermore, although the embodiments of the fixing device will be discussed in the context of a monochrome electrophotographic printer, one of ordinary skill in the art will recognize by understanding this specification that other types of electrophotographic printing systems such as electrophotographic copiers could use the fixing device.

Figure 1:
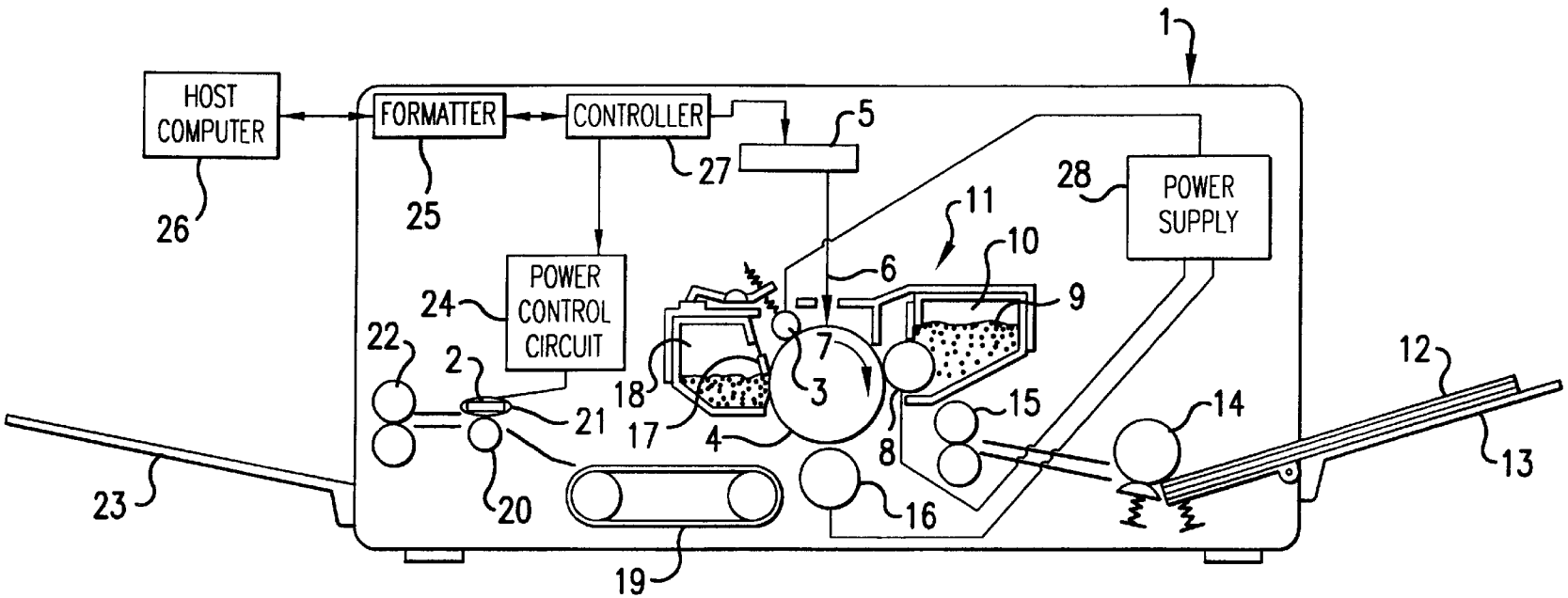
FIG. 1 is a simplified cross section of an electrophotographic printer including an embodiment of the fixing device.

Referring to FIG. 1, shown is a simplified cross sectional view of an electrophotographic printer 1 containing an embodiment of the fixing device including an instant on fuser 2. It should be recognized that although the disclosed embodiment of the fixing device is discussed in the context of an electrophotographic printer 1 using instant on type fuser 2, it could also be applied to other types fusers, such as a halogen bulb type fuser.

Charge roller 3 is used to charge the surface of photoconductor drum to a predetermined voltage. A laser diode (not shown) inside laser scanner 5 emits a laser beam 6 which is pulsed on and off as it is swept across the surface of photoconductor drum 4 to selectively discharge the surface of the photoconductor drum 4. Photoconductor drum 4 rotates in the clockwise direction as shown by the arrow 7. Developer roller 8 is used to develop the latent electrostatic image residing on the surface of photoconductor drum 4 after the surface voltage of the photoconductor drum 4 has been selectively discharged. Toner 9 which is stored in the toner reservoir 10 of electrophotographic print cartridge 11 moves from locations within the toner reservoir 10 to the developer roller 8. The magnet located within the developer roller 8 magnetically attracts the toner to the surface of the developer roller 8. As the developer roller 8 rotates in the counterclockwise direction, the toner on the surface of the developer roller 8, located opposite the areas on the surface of photoconductor drum 4 which are discharged, is moved across the gap between the surface of the photoconductor drum 4 and the surface of the developer roller 8 to develop the latent electrostatic image. A high voltage bias applied to developer roller 8 creates the electric field necessary to project toner from developer roller 8 onto photoconductor drum 4.

Print media 12 is loaded from paper tray 13 by pickup roller 14 into the paper path of the electrophotographic printer 1. Print media 12 moves through the drive rollers 1 so that the arrival of the leading edge of print media 12 below photoconductor drum 4 is synchronized with the rotation of the region on the surface of photoconductor drum 4 having a latent electrostatic image corresponding to the leading edge of print media 12. As the photoconductor drum 4 continues to rotate in the clockwise direction, the surface of the photoconductor drum 4, having toner adhered to it in the discharged areas, contacts the print media 12 which has been charged by transfer roller 16 so that it attracts the toner particles away from the surface of the photoconductor drum 4 and onto the surface of the print media 12. The transfer of toner particles from the surface of photoconductor drum 4 to the surface of the print media 12 does not occur with one hundred percent efficiency and therefore some toner particles remain on the surface of photoconductor drum 4. As photoconductor drum 4 continues to rotate, toner particles which remain adhered to its surface are removed by cleaning blade 17 and deposited in toner waste hopper 18.

As the print media 12 moves in the paper path past photoconductor drum 4, conveyer belt 19 delivers the print media 12 to fuser 2. Print media 12 passes between pressure roller 20 and the sleeve 21 surrounding instant on fuser 2.

Pressure roller 20 forces print media 12 against sleeve 21 deforming sleeve 21. Pressure roller 20 provides the drive force to rotate sleeve 21 around instant on fuser 2 as pressure roller 20 rotates. At the instant on fuser 2, heat is applied to print media 12 through the sleeve 21 so that the toner particles are fused to the surface of print media 12. Output rollers 22 push the print media 12 into the output tray 23 after it exits instant on fuser 2.

Power control circuit 24 applies power to instant on fuser 2 to control the temperature of instant on fuser 2. The embodiment of instant on fuser 2 shown in FIG. 1 uses multiple heating elements to provide the energy necessary to fuse toner to print media 12. An electrical parameter is monitored on one of the heating elements located on instant on fuser 2 in order to determine the thermal load applied to instant on fuser 2. In response to the monitoring of the electrical parameter, power control circuit 24 adjusts the power supplied to the remaining heating elements in order to compensate for the increased thermal load.

Formatter 25 receives print data, such as a display list, vector graphics, or raster print data, from the print driver operating in conjunction with an application program in host computer 26. Formatter 25 converts this relatively high level print data into a stream of binary print data. Formatter 25 sends the stream of binary print data to controller 27. In addition, formatter 25 and controller 27 exchange data necessary for controlling the electrophotographic printing process. Controller 27 supplies the stream of binary print data to laser scanner 5. The binary print data stream sent to the laser diode in laser scanner 5 pulses the laser diode to create the latent electrostatic image on photoconductor drum 4.

As part of initiating the electrophotographic printing process, controller 27 commands high voltage power supply 28 to apply the necessary bias voltages to charge roller 3, developer roller 8, and transfer roller 16 in order to develop an image onto print media 12. In addition, controller 27 controls a drive motor (not shown in FIG. 1) that supplies mechanical drive power to a printer gear train that moves various components in the electrophotographic system (such as photoconductor drum 4, pickup roller 14, and driver rollers 15). Controller 27 also initiates the application of power by power control circuit 24 to instant on fuser 2 so that instant on fuser 2 is ready to begin fusing toner to print media 12 when the print media moves between instant on fuser 2 and pressure roller 20. Power control circuit 24 initially supplies sufficient power to maintain the surface temperature of instant on fuser 2 at the fusing temperature for the average thermal load. As print media 12 moves between instant on fuser 2 and pressure roller 20, power control circuit 24 modulates the power supplied to instant on fuser 2 to compensate for a level of thermal loading different than the average thermal load. Further details on electrophotographic processes can be found in the text "The Physics and Technology of Xerographic Processes", by Edgar M. Williams, 1984, a Wiley-Interscience Publication of John Wiley & Sons, the disclosure of which is incorporated by reference herein.

Figure 2:
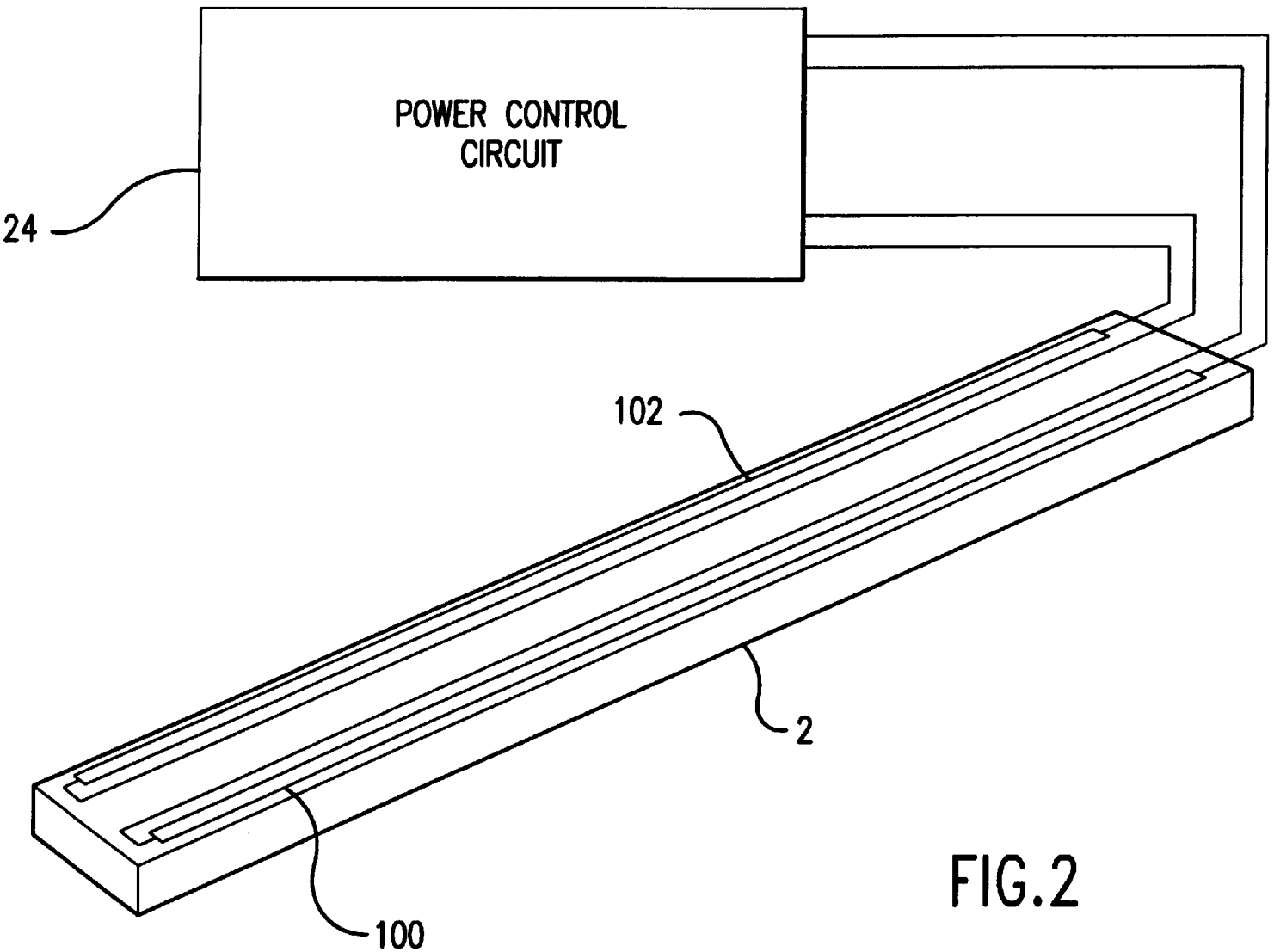
FIG. 2 shows an implementation of the fixing device using an instant on fuser.

Shown in FIG. 2 is a view of instant on fuser 2 coupled to power control circuit 24. Instant on fuser 2 includes a first heating element 100 and a second heating element 102. First heating element 102 is used for monitoring the thermal load applied to instant on fuser 2. First heating element 100 is positioned relative to second heating element 102 so that the leading edge of print media 12 passes over first heating element 100 before passing over second heating element 102.

It should be recognized that although the first heating element 100 shown in FIG. 2 has approximately the same width as second heating element 102, first heating element 100 could be narrow relative to the width of print media 12. Furthermore, although the first heating element 100 supplies sufficient power to print media 12 to assist in fixing toner, the level of power supplied to first heating element 100 may be less than that needed for fusing with the second heating element 102 supplying the majority of the heat required for fusing. Additionally, although instant on fuser 2 shown in FIG. 2 use two heating elements for fixing toner 9 to print media 12, one of ordinary skill could extend the concepts disclosed in this specification to implementations of an instant on fuser or a halogen bulb fuser using more than two heating elements.

Figure 3:
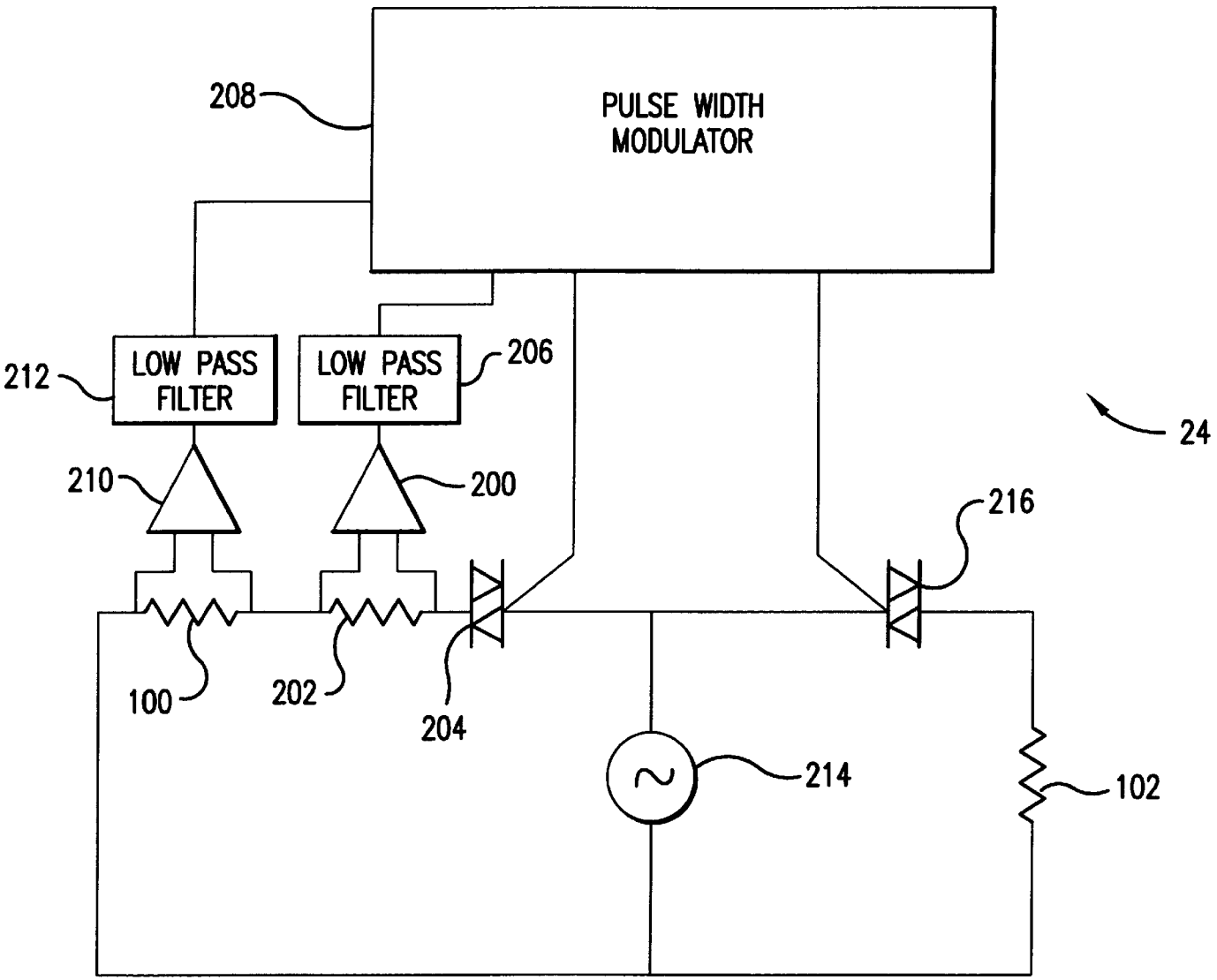
FIG. 3 shows a simplified schematic of a power control circuit used in the fixing device

Shown in FIG. 3 is a simplified schematic of power control circuit 24 and a line voltage source. Power control circuit 24 is configured to provide a constant power to first heating element 100 (represented as a resistive element). First buffer amplifier 200 is connected across current sense resistor 202. Current sense resistor 202 is located in series with first triac 204 to measure the current flowing through heating element 100. First low pass filter 206 is coupled to the output of first buffer amplifier 200. The output of first low pass filter 206 is coupled to pulse width modulator 208. Second buffer amplifier 210 is connected across first heating element 100. The output of second buffer amplifier 210 is coupled to second low pass filter 212. The output of second low pass filter 212 is coupled to pulse width modulator 208. A first output of pulse width modulator 208 is coupled the gate terminal of first triac 204. The power for first heating element 100 is supplied by line voltage source 214 which may be either a 110/120 V source or a 220/240 V source. Second heating element 102 is connected in series with second triac 216 and line voltage source 214. A second output of pulse width modulator 208 is connected to the gate terminal of second triac 216.

Pulse width modulator 208 is designed to regulate the value of power supplied to first heating element 100 to maintain the power dissipation in first heating element 100 substantially constant during the time in which first heating element 100 is operated. Substantially constant as it is used in the context of the power supplied to first heating element means maintaining the power dissipation across first heating element 100 within a range that is typical for the precision that can be achieved in electronic power control devices. First low pass filter 206 attenuates the ripple present in the voltage across current sense resistor 202. The output of first low pass filter 206 represents the average value of the current flowing through first heating element 100. Second low pass filter 212 attenuates the ripple present in the voltage across first heating element 100. The output of second low pass filter 212 represents the average value of the voltage across first heating element 100. Pulse width modulator 208 controls the pulse width of the drive signal supplied to the gate terminal of first triac 204 so that the product of the average value of the voltage across first heating element 100 and the average value of the current through first heating element 100 remains substantially constant. The product of the average voltage across and the average current through first heating element 100 is equal to the average power dissipation in first heating element 100. By maintaining the product of the average voltage and the average current substantially constant, the average power dissipation in first heating element 100 is substantially constant.

Pulse width modulator 208 is designed to set the power dissipation in first heating element 100 and second heating element 102 at a value corresponding to the average expected thermal load. The expected thermal load is determined by measuring the average characteristics (such as, basis weight, density, caliper, specific heat, moisture content) of the print media type anticipated to be used most frequently. Additionally, because toner coverage on the print media affects the thermal loading, the expected level of toner coverage would need to be measured to determine the expected thermal load.

Pulse width modulator 208 controls the power dissipated by first heating element 100 and second heating element 102 by setting the duty cycle of the drive signal applied to the gate terminal of first triac 204 and to the gate terminal of second triac 216. As previously mentioned, the duty cycle of the signals applied to the gate terminals of first triac 204 are set so that the power dissipated by first heating element 100 and second heating element 102 generates the temperature on the surface of instant on fuser 2 needed for properly fusing toner on print media 12 having average characteristics. However, proper fusing of toner is needed for print media presenting a wide range of thermal loads to instant on fuser 2.

Power control circuit 24 adjusts the power dissipation of second heating element 102 to compensate for variations in the thermal load applied to instant on fuser 2. When power control circuit 24 is commanded by controller 27 to begin applying power to first heating element 100 and second heating element 102, pulse width modulator 208 sets the duty cycle to the gate terminal of first triac 204 and second triac 216 so that the temperature on the surface of instant on fuser 2 is at the proper level for fusing toner onto print media 12 having average characteristics.

When the leading edge of the print media 12 to be fused moves between instant on fuser 2 and backup roller 20, first heating element 100 is encountered first. The thermal loading of first heating element 100 by print media 12 affects its resistance. Power control circuit 24 responds to this change in resistance by changing the duty cycle of the drive signal applied to the gate terminal of first triac 204 in order to maintain the product of the average voltage across and average current through first heating element 100 at a substantially constant value. Pulse width modulator uses the signals from first low pass filter 206 and second low pass filter 212 to make the necessary adjustments to the duty cycle of the drive signal applied to the gate terminal of first triac 204. If thermal loading by print media 12 decreases the resistance of first heating element 100, pulse width modulator 208 responds by changing the duty cycle to increase the current flow through first heating element 100 to maintain the power dissipated at a substantially constant value. If thermal loading by print media 12 increases the resistance of first heating element 100, pulse width modulator 208 responds by changing the duty cycle to decrease the current flow through first heating element 100 to maintain the power dissipated at a substantially constant value.

Pulse width modulator 208 includes a circuit to control the duty cycle of the signal used to drive the gate terminal of first triac 204 and a circuit to control the duty cycle of the signal used to drive the gate terminal of second triac 216. The signals from first low pass filter 206 and second low pass filter 212 are used by pulse width modulator 208 to adjust the duty cycle of the drive signal applied to the gate terminal of second triac 216. Based upon the knowledge of the relationship between the thermal load applied to first heating element 100 and the change in resistance that results (as indicated by the change in current flow), pulse width modulator 208 makes the necessary adjustment in the duty cycle of the drive signal applied to the gate terminal of second triac 216.

Consider the case in which the material used to construct first heating element 100 has a positive temperature coefficient of resistivity over the operating temperature range. If a constant voltage source were applied to first heating element 100, the application of a thermal load to first heating element 100 would tend to lower its temperature, resulting in a resistance decrease. The resistance decrease would, in turn, result in increased current flow through first heating element 100. For example, if the resistance changes by a factor of x ($0<x<1$), then the current flowing through first heating element 100 would increase by a factor of 1/x. Correspondingly, the power dissipated by first heating element 100 goes up by a factor of 1/x. The increase in the power dissipation by first heating element 100 resulting from the increase in the thermal load at least partially offsets the temperature decrease (and corresponding current increase) resulting from the increase in the thermal load. Therefore, accurately detecting a change in the thermal load is made more difficult by the effect of offsetting the temperature decrease.

Consider the case in which a constant current source is used to supply power to first heating element 100, with first heating element 100 constructed from a material having a negative temperature coefficient of resistivity. The application of a thermal load to first heating element 100 would tend to lower its temperature, resulting in a resistance increase. The resistance increase would, in turn, result in increased power dissipation in first heating element 100. For example if the resistance changes by a factor of x ($x>1$), then the voltage across first heating element 100 would increase by a factor of x. The increase in power dissipation by first heating element 100 resulting from the increase in the thermal load at least partially offsets the temperature decrease (and corresponding voltage increase) resulting from the increase in the thermal load. Therefore, accurately detecting a change in the thermal load is made more difficult by the effect of offsetting the temperature decrease.

The power control circuit 24 applies substantially constant power to first heating element 100. Because substantially constant power is applied, detecting changes in the thermal loading of instant on fuser 2 is more easily done than it would be if a constant current source or a constant voltage source were applied. Consider the case in which first heating element 100 is formed from a material having a positive temperature coefficient of resistivity over its operating temperature range. Applying a thermal load to first heating element 100 would tend to lower its temperature, resulting in a resistance decrease. In response, pulse width modulator 208 adjusts the duty cycle of the drive signal applied to first triac 204 in order to reduce the current flowing through first heating element 100 to maintain substantially constant power dissipation. Therefore, the change in the temperature of first heating element 100 brought about by an increase in the thermal load is not offset by an increase in the power dissipated in it, allowing for a more accurate detection of a change in the thermal load.

Pulse width modulator 208 uses the measurement of the average current through and average voltage across the first heating element 100 to control the power dissipation in second heating element 102. By knowing the relationship between the change in current through first heating element 100 or the change in voltage across first heating element 100 and the change in the thermal load, the power supplied to second heating element 102 can be adjusted to compensate for the change in thermal load applied to instant on fuser 2.

The functions of pulse width modulator 208 may be implemented in a variety of ways. For example, pulse width modulator 208 could be implemented using an analog multiplier to multiply the output of first low pass filter 212 and second low pass filter 206 to generate a feedback signal. The feedback signal could be applied to an error amplifier in the type of switch mode control circuits commonly used in commercially available integrated circuits. An example of the general class of switch mode control circuits that might be used is Motorola part number MC34063 discussed in Motorola application note AN920, the disclosure of which is incorporated into this patent application by reference. By properly selecting the reference voltage to which to compare the feedback signal, the duty cycle of the drive signal supplied to the gate of first triac can be set to provide the desired power to first heating element 100.

A second switch mode control circuit could use either the average current value from the output of first low pass filter 206 or the average voltage value from the output of second low pass filter 212 as a feedback signal to apply to the error amplifier in the switch mode control circuit. By properly selecting the reference voltage to which to compare the feedback signal, the duty cycle of the drive signal supplied to the gate of second triac 216 can be set to provide, to second heating element 102, the power necessary for fusing a large variety of print media types. An increasing thermal load on first heating element 100, results in a drop in the average voltage and average current outputs from first 206 and second low pass filter 212. The second switch mode control circuit would respond by increasing the duty cycle of the drive signal applied to the gate terminal of second triac 216, thereby boosting power supplied to second heating element 102.

Pulse width modulator 208 could also be implemented using analog to digital converters to digitize the output of first low pass filter 206 and second low pass filter 212. A processor in pulse width modulator 208 could perform a multiplication of these digitized outputs and use the result to generate a digital signal used to drive the gate terminal of first triac 204 in order to maintain constant power dissipation in first heating element 100. The processor could also generate a digital signal from one of the digitized outputs of first low pass filter 206 and second low pass filter 212 to drive the gate terminal of second triac 216 to compensate for a change in the thermal load detected by first heating element 100. Both of the digital signals used to drive the gate terminals of first triac 204 and second triac 216 may need to be level shifted in order to meet the drive requirements of the triac.

Alternatively, the processor could utilize a look-up table to select a duty cycle of the drive signals to the gate terminals of first triac 204 and second triac 216. In this alternative implementation, the processor computes an index based upon the values of the average current and average voltage associated with first heating element 100. The processor than uses the computed index to access the duty cycle values stored in the look-up table. With the duty cycle values loaded from the look-up table, the processor then applies the drive signals to the gate terminals of first triac 204 and second triac 216 in order to control the power dissipation in first heating element 100 and second heating element 102.

Figure 4:
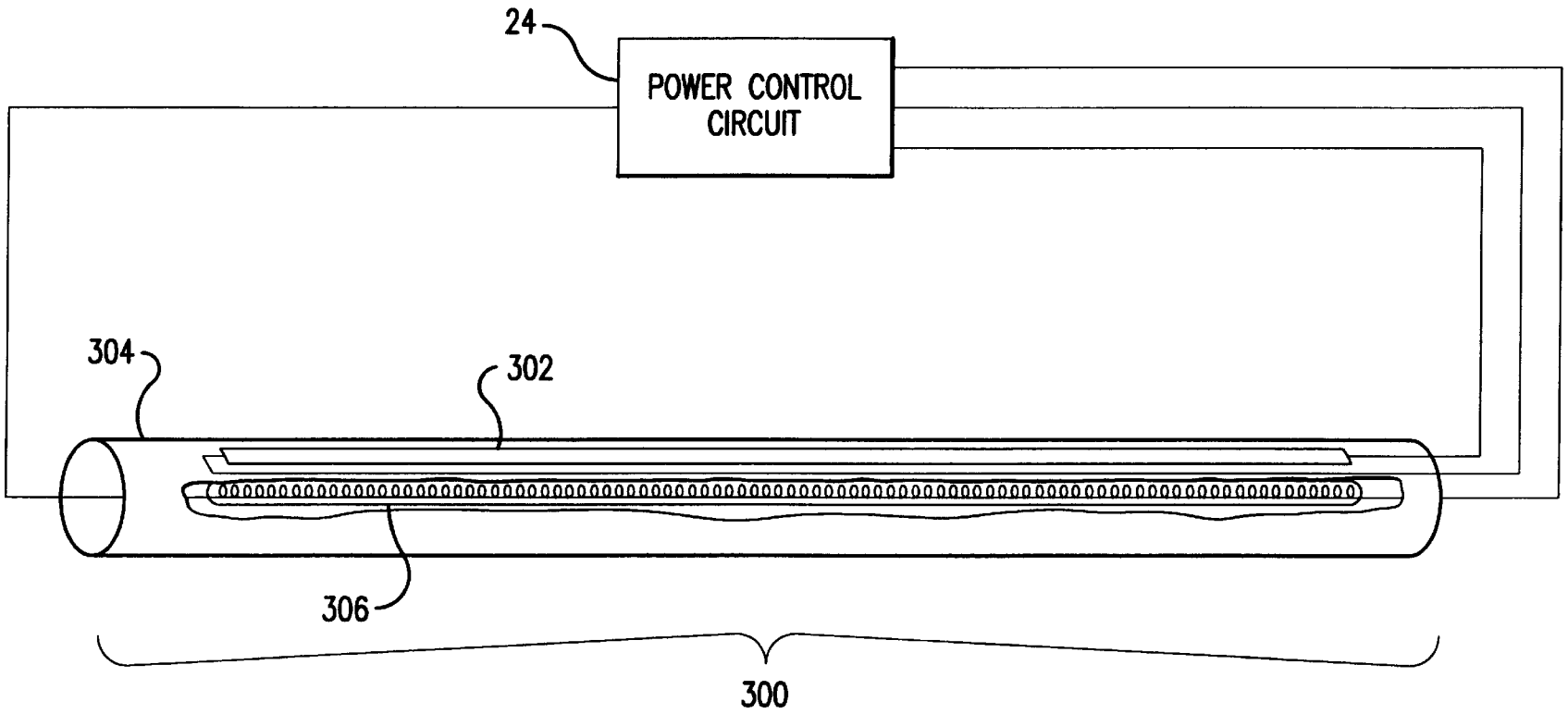
FIG. 4 shows an implementation of the fixing device using a halogen bulb fuser.

Shown in FIG. 4 is an implementation of a halogen bulb fuser 300 that could be used with the power control circuit 24 to adjust for changes in the thermal load applied to the halogen bulb fuser 300. In this implementation, sensing element 302, is used to detect the thermal load applied to halogen bulb fuser 300. Sensing element 302 may be constructed as a thin resistive heating element formed onto the surface of halogen bulb fuser 300. Sensing element 302 would be located on halogen bulb fuser 300 between the release layer covering the surface of halogen bulb fuser 300 and the wall of the cylinder 304 surrounding halogen bulb 306. The release layer is not shown in FIG. 4. Because cylinder 304 is typically formed from aluminum, sensing element 302 must be electrically insulated from the surface of cylinder 304. Halogen bulb 306 provides the primary source of energy for fixing toner 9 to print media 12. Power control circuit 24 supplies substantially constant power to sensing element 302. In a manner similar to adjustment of the power supplied to the instant on fuser 2, power control circuit 24 adjusts the power supplied to halogen bulb fuser 300 in response to changes in the thermal load.

Figure 5:
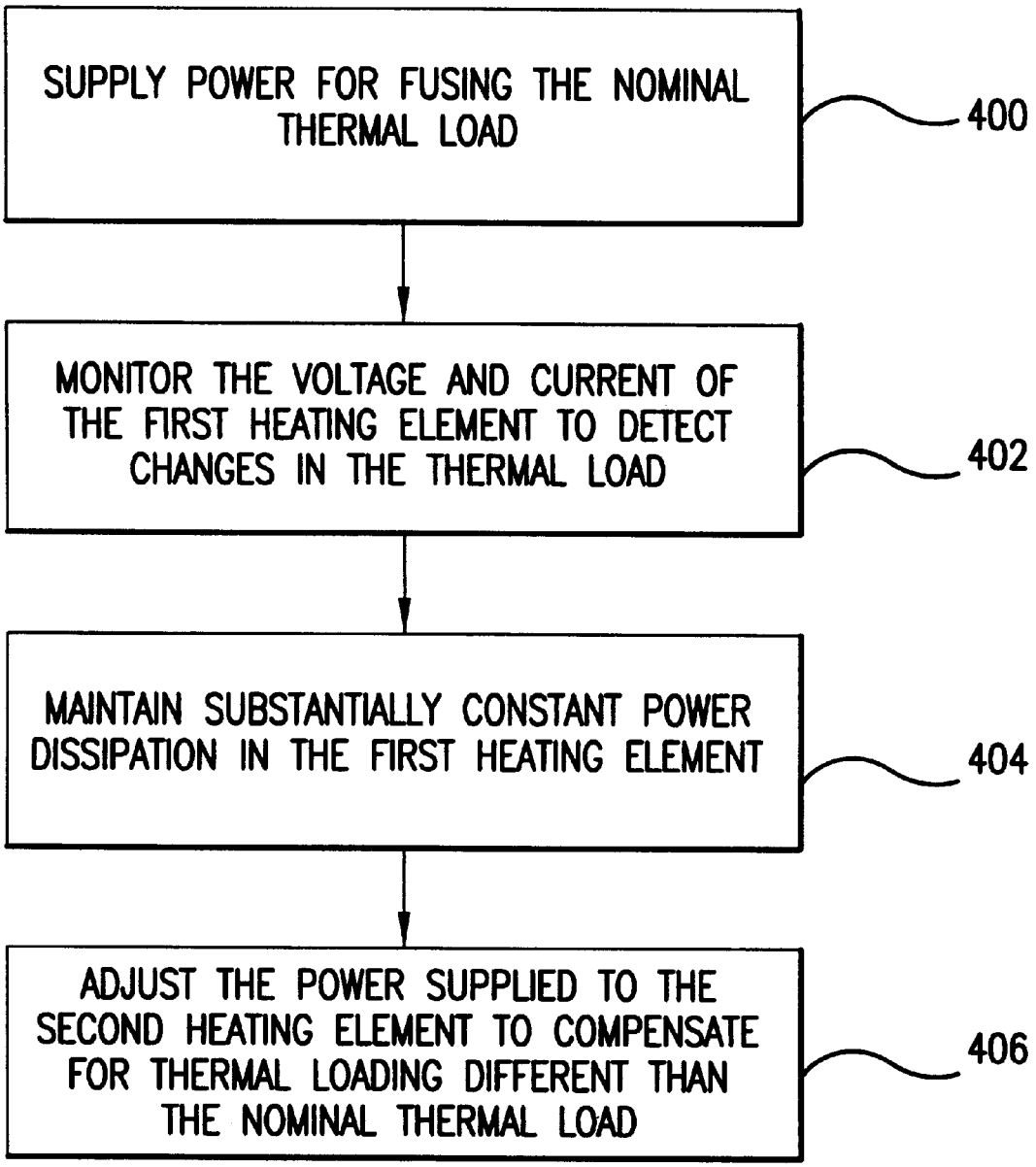
FIG. 5 shows a high level flow diagram of a method of the using the fixing device to compensate for changes in thermal loading.

Shown in FIG. 5 is a flow chart of a method for using the instant on fuser 2 with power control circuit 24. First, in step 400, a level of power sufficient for fixing toner to the nominal thermal load is applied to first heating element 100 and second heating element 102 by power control circuit 24. Next, in step 402, power control circuit 24 monitors the voltage across first heating element 100 and the current through first heating element 100 to detect changes in the thermal load applied to first heating element 100. Then, in step 404 power control circuit 24 maintains the power dissipation in first heating element 100 at a substantially constant level. Next, in step 406, power control circuit 24 adjusts the power applied to second heating element 102 to compensate for thermal loading different from the nominal thermal load.

Although several embodiments of the invention have been illustrated, and their forms described, it is readily apparent to those of ordinary skill in the art that various modifications may be made therein without departing from the spirit of the invention or from the scope of the appended claims.

What is claimed is:

1. A fixing device for fusing toner to print media, comprising:

a first heating element;

a second heating element; and a power control circuit configured for selectively supplying a substantially constant average power to the first heating element and configured for adjusting the power supplied to the second heating element in response to thermal loading of the first heating element by the print media.

2. The fixing device as recited in claim 1, wherein:

the capability of the power control circuit for adjusting the power supplied to the second heating element in response to thermal loading of the first heating element by the print media includes increasing the power supplied to the second heating element for thermal loading greater than a predetermined level and decreasing the power supplied to the second heating element for thermal loading less than the predetermined level.

3. Using a power supply for supplying power to the first heating element and the second heating element, the fixing device as recited in claim 2, wherein:

the power control circuit includes a first switch coupled in series with the first heating element and for coupling in series with the power supply;

the power control circuit includes a second switch coupled in series with the second heating element and for coupling in series with the power supply; and the power control circuit includes a pulse width modulator coupled to the first switch and the second switch, with the pulse width modulator configured for actuating the first switch to deliver substantially constant average power to the first heating element and configured for actuating the second switch to adjust the power supplied to the second heating element in response to thermal loading of the first heating element by the print media.

4. The fixing device as recited in claim 3, wherein:

the pulse width modulator supplies a first signal to the first switch and a second signal to the second switch;

the first signal switches between a first state, for placing the first switch in an open state, and a second state, for placing the first switch in a closed state; and the second signal switches between a third state, for placing the second switch in an open state, and a fourth state, for placing the second switch in a closed state.

5. The fixing device as recited in claim 4, wherein:

the pulse width modulator includes the capability to adjust a duration of the second state to deliver substantially constant average power from the power supply to the first heating element and the pulse width modulator includes the capability to adjust a duration of the fourth state to adjust the power supplied to the second heating element for thermal loading different than the predetermined level.

6. The fixing device as recited in claim 5, wherein:

the power control circuit includes a first sensor coupled to the pulse width modulator and configured for measuring a first parameter related to power dissipation in the first heating element;

the power control circuit includes a second sensor coupled to the pulse width modulator and configured for measuring a second parameter related to power dissipation in the first heating element; and the pulse width modulator includes the capability to adjust the duration of the second state responsive to at least one of the first parameter and the second parameter and includes the capability to adjust the duration of the fourth state responsive to at least one of the first parameter and the second parameter for thermal loading different than the predetermined level.

7. The fixing device as recited in claim 6, wherein:

the first parameter includes the current through the first heating element; and the second parameter includes the voltage across the first heating element.

8. The fixing device as recited in claim 7, wherein:

the first switch and the second switch each include a triac.

9. In a fixing device for fixing toner to print media, with the fixing device including a power control circuit, a first heating element coupled to the power control circuit, and a second heating element coupled to the power control circuit, a method for controlling the power applied to the second heating element to compensate for thermal loading by the print media different than a predetermined level of thermal loading, the method comprising the steps of:

applying a substantially constant average power to the first heating element;

applying power to the second heating element corresponding to the predetermined level of thermal loading; and adjusting the power supplied to the second heating element in response to thermal loading of the first heating element different than the predetermined level of thermal loading.

10. The method as recited in claim 9, wherein:

the step of adjusting includes increasing the power the supplied to the second heating element for thermal loading greater than the predetermined level and decreasing the power supplied to the second heating element for thermal loading less than the predetermined level.

11. With the power control circuit including a first switch coupled in series with the first heating element and for coupling to a power supply, a second switch coupled in series with the second heating element and for coupling to the power supply, and a pulse width modulator coupled to the first switch and the second switch, the method as recited in claim 10, wherein:

the step of applying the substantially constant average power to the first heating element includes actuating the first switch; and the step of applying power to the second heating element corresponding to the predetermined level of thermal loading includes actuating the second switch.

12. With the pulse width modulator supplying a first signal to the first switch and a second signal to the second switch, with the first signal switching between a first state, for placing the first switch in an open state, and a second state, for placing the first switch in a closed state, and with the second signal switching between a third state, for placing the second switch in an open state, and a fourth state, for placing the second switch in a closed state, the method as recited in claim 11, wherein:

the step of applying the substantially constant average power to the first heating element includes adjusting a duration of the second state; and the step of adjusting includes adjusting a duration of the fourth state for thermal loading of the first heating element different than the predetermined level.

13. With the power control circuit including a first sensor coupled to the first heating element and the pulse width modulator and with the power control circuit including a second sensor coupled to the first heating element and the pulse width modulator, the method as recited in claim 12, wherein:

the step of applying the substantially constant average power to the first heating element includes measuring a first parameter related to power dissipation in the first heating element and measuring a second parameter related to power dissipation in the first heating element; and the step of adjusting the duration of the second state includes adjusting the duration of the second state in response to at least one of the first parameter and the second parameter.

14. An electrophotographic printing system for printing print data on print media using toner, comprising:

a formatter arranged for receiving the print data to generate formatted print data;

a scanner configured for receiving the formatted print data to generate a laser beam modulated based upon the formatted print data;

a photoconductor onto which the laser beam impinges to generate a latent electrostatic image;

a developer for developing the toner onto the latent electrostatic image;

a transfer device for transferring the toner on the photoconductor onto the print media; and a fixing device including a first heating element, a second heating element, and a power control circuit configured for selectively supplying a substantially constant average power to the first heating element and configured for adjusting the power supplied to the second heating element in response to thermal loading of the first heating element by the print media.

15. The electrophotographic printing system as recited in claim 14, wherein:

the capability of the power control circuit for adjusting the power supplied to the second heating element in response to thermal loading of the first heating element by the print media includes increasing the power supplied to the second heating element for thermal loading greater than a predetermined level and decreasing the power supplied to the second heating element for thermal loading less than the predetermined level.

16. Using a power supply for supplying power, the electrophotographic printing system as recited in claim 15, wherein:

the power control circuit includes a first switch coupled in series with the first heating element and for coupling in series with the power supply;

the power control circuit includes a second switch coupled in series with the second heating element and for coupling in series with the power supply; and the power control circuit includes a pulse width modulator coupled to the first switch and the second switch, with the pulse width modulator configured for actuating the first switch to deliver substantially constant average power to the first heating element and configured for actuating the second switch to adjust the power supplied to the second heating element in response to thermal loading of the first heating element by the print media.

17. The electrophotographic printing system as recited in claim 16, wherein:

the pulse width modulator supplies a first signal to the first switch and a second signal to the second switch;

the first signal switches between a first state, for placing the first switch in an open state, and a second state, for placing the first switch in a closed state; and the second signal switches between a third state, for placing the second switch in an open state, and a fourth state, for placing the second switch in a closed state.

18. The electrophotographic printing system as recited in claim 17, wherein:

the pulse width modulator includes the capability to adjust a duration of the second state to deliver substantially constant average power from the power supply to the first heating element and the pulse width modulator includes the capability to adjust a duration of the fourth state to adjust the power supplied to the second heating element for thermal loading different than the predetermined level.

19. The electrophotographic printing system as recited in claim 18, wherein:

the power control circuit includes a first sensor coupled to the pulse width modulator and configured for measuring a first parameter related to power dissipation in the first heating element;

the power control circuit includes a second sensor coupled to the pulse width modulator and configured for measuring a second parameter related to power dissipation in the first heating element; and the pulse width modulator includes the capability to adjust the duration of the second state responsive to at least one of the first parameter and the second parameter and to adjust the duration of the fourth state responsive to at least one of the first parameter and the second parameter for thermal loading different than the predetermined level.

20. The electrophotographic printing system as recited in claim 19, wherein:

the first parameter includes the current through the first heating element; and the second parameter includes the voltage across the first heating element.

* * * * *